United States Patent [19]

Putnam

[11] Patent Number: 4,934,559

[45] Date of Patent: Jun. 19, 1990

[54] DOOR BAR HANDLE FOR GLASS DOOR OF CLOTHES DRYER

[75] Inventor: Brett J. Putnam, Ripon, Wis.

[73] Assignee: Speed Queen Company, Ripon, Wis.

[21] Appl. No.: 363,016

[22] Filed: Jun. 8, 1989

[51] Int. Cl.[5] ..... B65D 51/00

[52] U.S. Cl. ..... 220/377; 220/94 A; 34/108; 49/460

[58] Field of Search ..... 220/314, 334, 377, 85 E, 220/85 K, 94 R, 94 A, DIG. 21; 49/50, 55, 57, 58, 460; 34/108, 127; 16/DIG. 2, 111 R

[56] References Cited

U.S. PATENT DOCUMENTS

| | | | |
|---|---|---|---|
| 2,650,490 | 9/1953 | Glassey | 34/108 X |
| 2,870,493 | 1/1959 | Beyrle | 49/460 |
| 2,870,545 | 1/1959 | Richterkessing | 34/127 X |
| 2,883,714 | 4/1959 | May | 49/460 |
| 4,095,372 | 6/1978 | Rittner | 49/460 |
| 4,364,666 | 12/1982 | Keyes | 220/377 X |
| 4,467,574 | 8/1984 | Falge et al. | 49/50 X |

*Primary Examiner*—Stephen Marcus
*Assistant Examiner*—Nova Stucker
*Attorney, Agent, or Firm*—William R. Clark; Richard M. Sharkansky

[57] ABSTRACT

A door bar handle for a clothes dryer having a front loading glass door. The door bar attaches to opposite sides of the door frame and spans across in front of the glass to prevent it from being struck by laundry carts and the like. A portion of the door bar is spaced from the glass so as to provide a handle for opening and closing the door, but the remainder of the mid-portion of the door bar is close to the glass so that it won't be used as a hanger rod.

2 Claims, 2 Drawing Sheets

DOOR BAR HANDLE FOR GLASS DOOR OF CLOTHES DRYER

BACKGROUND OF THE INVENTION

The invention generally relates to commercial clothes dryers that have front-loading doors with glass windows, and more particularly relates to door bar handles for such clothes dryer doors.

Many clothes dryers, especially those of the commerical type, have a front-loading door with a glass window so as to provide a view of the drying chamber. These windows are susceptible to damage or breakage, and they are particularly susceptible in a stacked dryer configuration where the door of the bottom dryer is relatively close to the floor. More specifically, in a stacked dryer configuration where one dryer is supported on top of another, the glass window or pane of the lower door may typically be only 21" off the floor as compared to a single or unstacked dryer configuration where the door may typically be 43" off the floor. With a glass door positioned relatively close to the floor, carts or the like can easily be pushed into it, and also it can be kicked.

SUMMARY OF THE INVENTION

It is an object of the invention to provide apparatus that reduces the likelihood of damage to the glass window of a front-loading clothes dryer door.

It is a further object to provide a door bar that spans across in front of the window so that foreign objects that are pushed or swung towards the door, strike the door bar rather than the window, thereby saving the glass from damage or breakage.

It is a further object to provide a door bar that also serves as a door handle for opening and closing the dryer door.

It is another object that the door bar handle be configured so as to eliminate or discourage the user from hanging clothes hangers on the door bar.

In accordance with the invention, a clothes dryer having a front-loading door with a peripheral door ring surrounding a transparent window pane is provided with a door bar having one end attached to one side of the door ring and the other end attached to the opposite side of the door ring. The mid-portion of the door bar spans across the door in front of the window pane to shield the pane from being struck by a moving object that could cause damage to the pane. The mid-portion further has at least a section sufficiently spaced from the pane so as to provide a handle for opening the door. The handle section preferably has a width approximately the width of a hand, and the remaining section of the mid-portion is located close to the window pane so as to discourage its use as a clothes hanging rod. Preferably, the door ring has an outward face band and an annular wall that extends inwardly to a window pane mounting. The door bar is attached at the pull side of the door ring by a securing member such as a screw engaging it to the annular wall while the opposite or hinge side of the door bar is secured to the face band of the door ring. The hinge side of the door bar may be attached using a screw that passes through a radially elongated slot in the door bar so as to compensate for door rings that have variable diameters.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
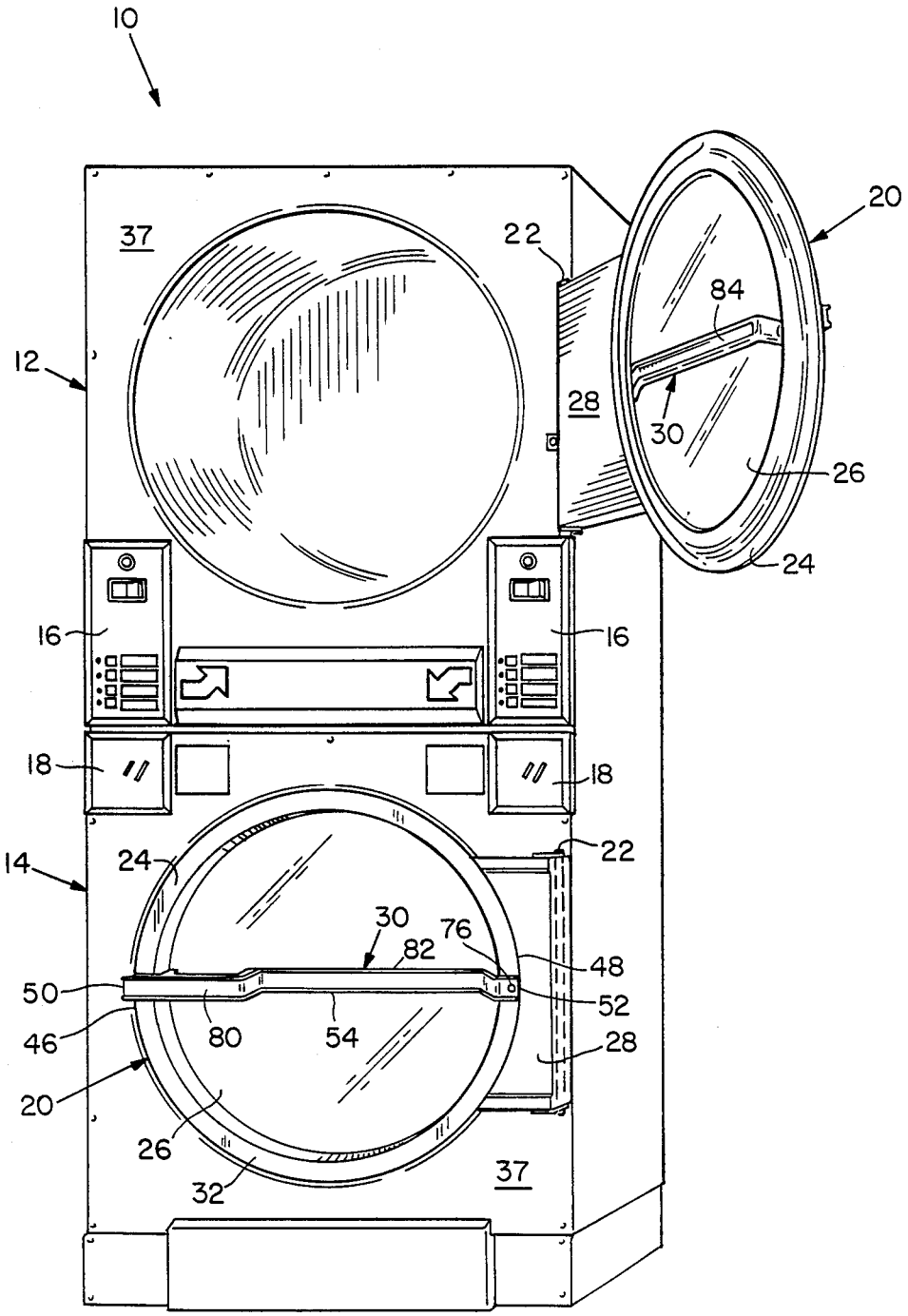
FIG. 1 is a perspective view of a stacked commercial dryer unit having front-loading glass doors.

Referring to FIG. 1, a stacked commercial clothes dryer unit 10 is shown. That is, one tumber clothes dryer 12 is supported on top of a second tumbler clothes dryer 14 so that a relatively large number of clothes dryers 12 and 14 can be located in a relatively small area of floor space. As is well known in the art, each dryer 12 and 14 is provided with its own control module 16 which includes a coin drop cartridge 18. Each dryer also has a front-loading door 20 with hinges 22 at one side. Each door 20 has a stainless steel door ring 24 or frame to which a window pane 26 is mounted. By making the window pane 26 of a transparent material such as glass, the operation of the dryer can be viewed; also, it is easy to tell at a glance which dryers are available for use, and which dryers contain clothes. Each door 20 also includes a mounting bracket 28 that attaches to the door ring 24 on one side, and is coupled to a hinge 22 on the other side. Conventional dryer components such as a heat source, a blower, a motor and a tumbler drive mechanism are not shown as their operation is well known and not required for understanding of the present invention.

In accordance with the invention, a door bar 30 is provided for door 20. Although the invention can be used to advantage with clothes dryers other than the stacked variety as shown, it has particular advantage with a stacked commercial clothes dryer unit 10 because the bottom dryer 14 is relatively close to the floor and therefore its window pane 26 is particularly susceptible to being struck or bumped by a clothes cart or the like. More specifically, in a typical stacked dryer configuration, the window pane 26 may be approximately 21" off the floor as contrasted with the door of a single or unstacked tumbler dryer that may typically be approximately 43" of the floor. Accordingly, with the door 20 of the bottom dryer 14 close to the floor, it is much more likely that it will be struck by a cart or other foreign object or kicked by a foot. Door bar 30 serves to deflect or absorb such blows by foreign objects so that window pane 26 is spared from damage or breakage.

Figure 2:
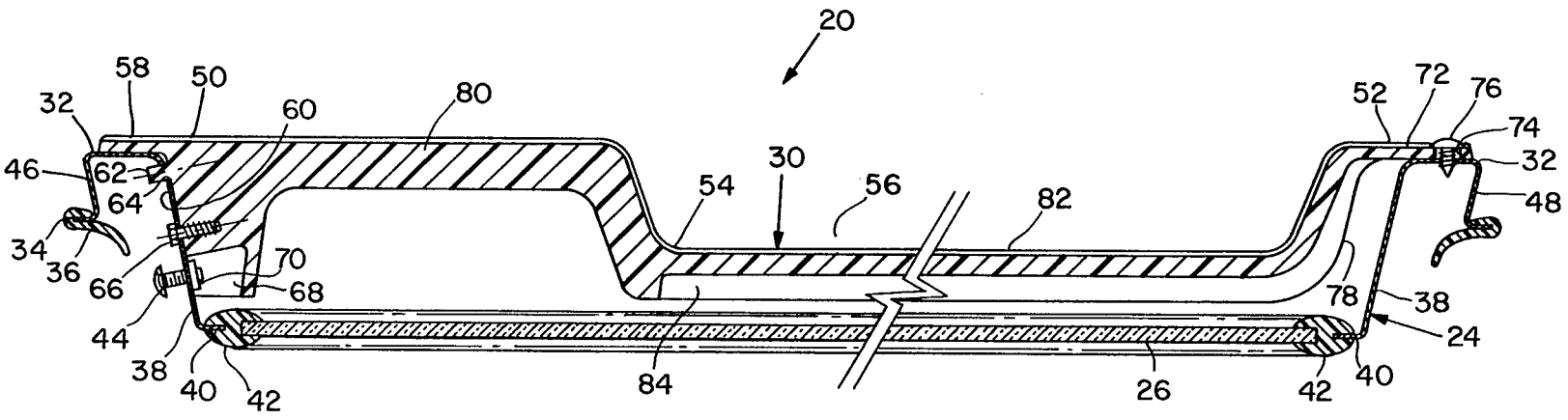
FIG. 2 is a sectioned view of a door of FIG. 1 including the door bar handle.

Also referring to FIG. 2, a sectioned view of door 20 is shown. Door ring 24 or frame has an outward circular face band 32. On the outside of face band 32, frame 24 bends inwardly to a radial circumferential flange 34 to which annular gasket 36 is attached. As is well known, gasket 36 seats against the front panel 37 during operation to seal door 20. On the inside of face band 32, frame 24 or ring bends inwardly to form an annular wall 38 that tapers toward the center of door 20. Connected to the inward end of wall 38 is an inwardly directed radial flange 40 to which window pane 26 is conventionally secured using door glass seal 42 or gasket. A door striker 44 is connected to the pull side 46 of ring 24, and the mounting bracket 28 is attached to the opposite or hinge side 48. With the exception of door bar 30, the arrangement of door 20 as described heretofore is well known and conventional.

In accordance with the invention, door bar 30 has been added to door 20. As shown in FIG. 2, door bar 30 has one end 50 attached to the pull side 46 of ring 24, and the other end 52 is attached to the opposite or hinge side 48 of ring 24. The mid-portion 54 of door bar 30 between end 50 and 52 spans across the central aperture 56 of ring 24 or frame in front of window pane 26, and thereby serves as a shield to prevent damage to window pane 26.

Still referring to FIG. 2, the pull end 50 of door bar 30 attaches to the side 46 of ring 24 that is opposite the side 48 to which the hinge mounting bracket 28 is attached. The pull end 50 has a flange 58 that seats in front of face band 32 and the inner side 60 of the pull end 50 is contoured so as to conform and seat flushly against wall 38. Inner side 60 has a boss 62 that inserts through a locater hole 64 in wall 38 thereby aligning door bar 30 to ring 24. One or more screws 66 are then inserted laterally through wall 38 and are securely anchored into the pull end 50 of door bar 30. Although door bar 30 may be made from a variety of different materials including plastics and metal, it has been found that foam polypropylene is a very suitable material, as it can readily be molded and is relatively hard in its molded state. As shown, the pull end 50 may preferably have a molded cavity 68 which receives the internal portion 70 of striker 44.

The other end 52 of door bar 30 has a flange 72 that seats flushly against the opposite or hinge side 48 of face band 32. It has been found that the lateral width of rings 24 or frames can deviate on the production line. In order to accommodate or fit the relatively fixed length molded door bars 30 to the variable diameter door rings 24, the hole 74 in the flange 72 to which the screw 76 is inserted is radially elongated. Accordingly, even though there may not be a consistent alignment between flange 72 and face band 32, screw 76 can still be inserted down through hole 74 into a fixed hole in face band 32 so as to secure end 52 of door bar 30 to the hinge side 48 of ring 24. Also, the inner side 78 of end 52 is configured so as to be spaced from wall 38. In other words, end 50 is flush against wall 38, but the other end 52 is not flush with the opposite wall 38. As can be seen, the pull end 50 of door bar 30 where handle 80 is located and where the greatest opening force is exerted is snuggly fit against ring 24 and may be attached by a plurality of screws; on the other hand, screw 76 is used at the other end 52 where there is less opening force exerted.

End 52 to door bar 30 is directed inwardly adjacent wall 38 such that a substantial segment 82 of the mid-portion 54 of door bar 30 is closely spaced or touching window pane 26. Accordingly, users are prevented or at least discouraged from trying to hang clothes hangers from door bar 30. Such hanging, if permitted, could scratch glass pane 26, and also could put undue stress on hinges 22. As shown, the underside 84 of door bar 30 can be hollowed out to reduce the molded material required for door bar 30 and also may prevent sink marks on the front side of door bar 30.

The mid-portion 54 of door bar 30 also includes a handle 80 which is formed by spacing door bar 30 from window pane 26 for a distance approximately the width of a hand. That is, handle 80 may typically have a lateral width in the range from 3.5–4.5 inches. Accordingly, the user can grasp the handle 80 to open and close door 20, but the lateral width of handle 80 is not so large so as to encourage the hanging of clothes hangers.

The vertical height of door bar 30 should be large enough so as to provide sufficient strength, and also to be effective as a shield. On the other hand, if door bar 30 is too large, it could interfere with the view through window pane 26. A typical height may be 1–2 inches. In an alternate embodiment, door bar 30 may be made higher while not detracting from the view by using two or more vertically spaced mid-portions 54 that are joined at ends 50 and 52.

In operation, door bar 30 provides a protective shield so as to prevent or at least reduce the probability of a cart or the like being pushed into and damaging window pane 26. Door bar 30 also functions as a handle 80, thereby eliminating the need for an additional part and associated attachment mechanisms. While handle 80 is spaced from window pane 26 so as to allow a hand to be inserted therebetween, the remainder of the mid-portion 54 of door bar 30 is positioned close to window pane 26 so that users don't use door bar 30 as a hanger rod.

This concludes the Description of the Preferred Embodiment. However, a reading of it by those skilled in the art will bring to mind many alterations and modifications that do not depart from the spirit and scope of the invention. Accordingly, it is intended that the invention be limited only by the appended claims.

What is claimed is:

1. In a clothes dryer having a front loading door with a peripheral door ring surrounding a transparent window pane, a door bar having one end attached to one side of the door ring and the other end attached to the opposite side of the door ring with a mid-portion of the door bar spanning across the door in front of the window pane to shield the pane from being struck by a moving object that could cause damage to the pane, the mid-portion comprising means for inhibiting hangers from being hung on a substantial portion of the mid-portion and for providing a handle for opening the door, the means comprising a first section of the mid-portion covering a substantial portion of the span across the window pane and being closely spaced or touching the window pane, the means further comprising a second section of the mid-portion being sufficiently spaced from the pane so as to provide a handle for opening the door.

2. In a clothes dryer having a front loading door with a peripheral door ring surrounding a transparent window pane, a door bar having one end attached to one side of the door ring and the other end attached to the opposite side of the door ring with a mid-portion of the door bar spanning across the door in front of the window pane to shield the pane from being struck by a moving object that could cause damage to the pane, the mid-portion having at least a section sufficiently spaced from the pane so as to provide a handle for opening the door, said handle being approximately the length of a hand, and the remaining section of the mid-portion being positioned close to the window pane, said door ring having an outward face band and an annular wall extending inwardly to a window pane mounting, the door bar being attached at the one side by a securing member engaged to the wall, the door bar being attached at the opposite side by a securing member engaged to the face band.

* * * * *